United States Patent [19]

Donachie et al.

[11] Patent Number: 4,808,225

[45] Date of Patent: Feb. 28, 1989

[54] METHOD FOR PRODUCING AN ALLOY PRODUCT OF IMPROVED DUCTILITY FROM METAL POWDER

[75] Inventors: Stephen J. Donachie, New Hartford; James W. Fesko, Clinton; James J. Furgal, Clinton; Francis E. Sczerzenie, Clinton, all of N.Y.

[73] Assignee: Special Metals Corporation, New Hartford, N.Y.

[21] Appl. No.: 146,553

[22] Filed: Jan. 21, 1988

[51] Int. Cl.[4] ..... H22F 3/00

[52] U.S. Cl. ..... 75/246; 75/65 ZM; 419/38; 419/47; 419/62; 419/66; 420/451; 420/590

[58] Field of Search ..... 419/38, 47, 62, 66; 75/246, 65 ZM; 420/451, 590

[56] References Cited

U.S. PATENT DOCUMENTS 3,704,508 12/1972 DiGiambattista .
3,907,550 9/1975 Critchlow ..... 29/599
4,310,354 1/1982 Fountain et al. .
4,394,183 7/1983 Jackson et al. ..... 75/65 ZM
4,665,970 5/1987 Ohno ..... 75/65 ZM
4,719,077 1/1988 Suzuki et al. ..... 75/246

FOREIGN PATENT DOCUMENTS 1259441 1/1972 United Kingdom .

*Primary Examiner*—Stephen J. Lechert, Jr.
*Attorney, Agent, or Firm*—Robert F. Dropkin

[57] ABSTRACT

A process for producing an alloy product of improved ductility from metal powder. It includes the steps of: providing metal powder having at least 5 wt. % of one or more reactive elements from the group consisting of titanium, aluminum, hafnium, niobium, tantalum, vanadium and zirconium; consolidating the powder to an essentially fully dense shape; and progressively melting and solidifying localized areas of the consolidated shape so as to produce a product of improved ductility.

9 Claims, No Drawings

METHOD FOR PRODUCING AN ALLOY PRODUCT OF IMPROVED DUCTILITY FROM METAL POWDER

The present invention relates to a method for producing an alloy product of improved ductility from metal powder and to the product produced thereby.

Full density powder metallurgy products are used in very demanding applications. This use is generally attributable to (a) the fine-grain structure inherent in powder (if preserved) and properties attributable thereto, and/or (b) problems in producing uniform properties in large sections, due to segregation, through conventional melting and solidification.

A problem which has plagued powder processes is contamination of surfaces of unconsolidated powders. Such contamination often precludes full bonding during consolidation.

Surface contamination is particularly difficult to deal with in that only small levels of contaminant are necessary to cause problems and in that such small levels are generally not identifiable by non-destructive testing of parts. It is particularly prevalent when reactive metals, such as titanium, aluminum, hafnium, niobium, tantalum, vanadium and zirconium, are present. Titanium is, for example, extremely reactive with oxygen.

Through the present invention, we have developed a process for eliminating/lessening the deleterious effects of surface contamination on ductility. Consolidated powder shapes are subjected to progressive melting and solidification of localized areas.

A process for treating and compacting metal powder is disclosed in U.S. Pat. No. 3,704,508. The process described therein pertains to consolidation by heat in the presence of an electron donor compound to a temperature just below the solidus point of the powder. It does not pertain to progressive localized melting.

It is an object of the present invention to provide a method for producing an alloy product of improved ductility from metal powder.

The present invention provides a method for producing an alloy product of improved ductility from metal powder. It comprises the steps of: providing metal powder having at least 5 wt. % of one or more reactive elements from the group consisting of titanium, aluminum, hafnium, niobium, tantalum, vanadium and zirconium; consolidating the powder to an essentially fully dense shape; and progressively melting and solidifying localized areas of the consolidated shape so as to produce a product of improved ductility.

Although the invention is believed to be applicable to a wide range of powders, in either elemental or prealloyed form, including nickel-, iron- and cobalt-base alloys and alloys of titanium and aluminum, nickel-titanium alloys containing at least 45 wt. % nickel and at least 30 wt. % titanium appear to be the most important at the present time. These nickel-titanium alloys usually contain from 53 to 62 wt. % nickel, balance essentially titanium.

Nickel-titanium alloys are disclosed in U.S. Pat. No. 4,310,354. This patent discloses a process for producing nickel-titanium and other shape memory alloys having a desired transition temperature. Two prealloyed powders of dissimilar transition temperature are blended, consolidated and heat treated.

The powder of the present invention may be produced and/or consolidated in accordance with processes well known to those skilled in the art. These processes include inert gas atomization, spinning disk atomization, hot isostatic pressing, cold pressing and sintering, and the process of heretofore referred to U.S. Pat. No. 3,704,508. An essentially fully dense consolidated shape is fundamentally free of interconnected porosity. It is generally characterized by a density of at least 95%.

Vacuum arc melting is a means for melting and solidifying localized areas of the consolidated shape so as to produce an ingot of improved ductility. A vacuum arc process is disclosed in British Patent Specification No. 1,259,44. Note how melting progresses from the bottom of electrode 6 to the top. Only localized areas are molten at any particular time. Molten metal drips from the electrode into mold 3.

Alternative melting processes include electroslag melting, double electrode melting, electron beam melting, plasma melting and zone melting. The only restraint is that the molten zone be kept sufficiently small to essentially prevent segregation from occurring.

Melting is generally performed in a protective atmosphere. Protective atmospheres are well known to those skilled in the art. They include vacuum and inert gas environments.

The invention may also include the steps of hot rolling and drawing of the product formed during melting. Wire is a product form for alloy produced in accordance therewith.

The following examples are illustrative of several aspects of the invention.

EXAMPLE A

A billet was produced from several heats of atomized nickel-titanium powder. The nominal titanium content for the heats ranged from 44.3 to 44.5 wt. %. The heats were blended together based upon measurement of their transition temperatures, as described in heretofore referred to U.S. Pat. No. 4,310,354. The powder blend was canned, evacuated and hot isostatically pressed to produce a fully dense billet. The canned billet was hot cogged to 2.25-inch square bar and sectioned into lengths for subsequent rolling.

Transition temperatures were measured at each end of the cogged 2.25-inch bar and were −2° C and +2° C. respectively. These measurements demonstrate the excellent uniformity of properties which are attainable by the powder process.

The 2.25-inch bar was hot rolled to 0.43-inch diameter round rod and subsequently drawn to 0.024-inch diameter wire. It fractured more than thirty-four times during drawing. The fractures were attributable to insufficient ductility. Bend testing of the wire confirmed this finding. Drawing is more demanding of material ductility than is rolling.

EXAMPLE B

A billet was prepared from several heats of atomized nickel-titanium powder. The nominal titanium content for the heats ranged from 44.3 to 44.7 wt. %. The heats were blended together based upon measurement of their transition temperatures, as described in heretofore referred to U.S. Pat. No. 4,310,354. The powder blend was canned, evacuated and hot isostatically pressed to produce a fully dense billet. This billet was not, however, cogged subsequent to decanning as was the billet of Example A. It was arc melted in a vacuum subsequent to decanning and then cogged to 2.25-inch square bar.

Transition temperatures were measured at each end of the cogged 2.25-inch bar and were +8° C. and +9° C. These measurements, as was the case for those of Example A, demonstrate the excellent uniformity of properties which are attainable by the powder process. The strived-for transition tempera ture for Example B, on which blending is based, was, however, different from that for Example A.

The 2.25-inch bar was hot rolled to 0.43-inch diameter round rod and subsequently drawn to 0.024-inch diameter wire. With the exception of a single incident caused by a failure in the wire drawing take-up, there was no breakage of the wire. Bend testing of the wire indicated excellent fabricability.

A comparison of Examples A and B reveals that progressive melting and solidification of localized areas of an essentially fully dense billet significantly increases the ductility of the resulting ingot. Progressive melting preserved the uniformity of properties attributable to the powder process, and at the same time, eliminated failures attributable to powder surface contamination.

Additional transition temperature measurements for the material of Example B were made at spaced intervals along the hot-rolled rod. The minimum transition temperature was +9° C. and the maximum was +13° C. Uniformity of properties was evident after hot rolling.

EXAMPLE C

A nickel-titanium ingot was produced by conventional vacuum induction melting. The nominal titanium content was 44.7 wt. %.

The ingot was arc melted in a vacuum as was the billet of Example B. The resulting electrode was cogged to 2.25-inch square bar and hot rolled to 0.43-inch diameter round rod.

Transition temperature measurements were made at spaced intervals along the hot-rolled rod. The minimum transition temperature was −30° C. and the maximum was +45° C.

The material of this example was not processed to wire. High variability (−30° to +45° C.) of transition temperature rendered it unsatisfactory. The failure of this product confirms the advantages of the process of the present invention, as illustrated in Example B hereinabove.

It will be apparent to those skilled in the art that the novel principles of the invention disclosed herein in connection with the specific examples thereof will suggest various other modifications and applications of the same. It is accordingly desired that, in construing the breadth of the appended claims, they shall not be limited to the specific examples of the invention described herein.

We claim:

1. In a process for producing an alloy product of improved ductility from metal powder, which process includes the steps of: providing atomized metal powder having at least 5 wt. % of one or more reactive elements from the group consisting of titanium, aluminum, hafnium, niobium, tantalum, vanadium and zirconium; and consolidating said powder to an essentially fully dense shape fundamentally free of interconnected porosity; the improvement comprising the step of progressively melting and solidifying localized areas of said consolidated shape so as to produce a product of improved ductility.

2. A process according to claim 1, wherein said metal powder has at least 5 wt. % titanium.

3. A process according to claim 2, wherein said metal powder is a prealloyed powder containing at least 45 wt. % nickel and at least 30 wt. % titanium.

4. A process according to claim 3, wherein said metal powder is essentially a nickel-titanium binary alloy containing from 53 to 62 wt. % nickel.

5. A process according to claim 4, including the steps of: providing at least two prealloyed powders of dissimilar transition temperature; and blending said powders.

6. A process according to claim 1, wherein the consolidated powder is arc melted in a protective atmosphere.

7. A process according to claim 1, wherein said powder is hot isostatically pressed.

8. A process according to claim 1, including the steps of hot rolling and drawing said product to wire.

9. A nickel-titanium alloy of improved ductility, made in accordance with the process of claim 1.

* * * * *